United States Patent [19]

Jondahl

[11] Patent Number: 4,509,450

[45] Date of Patent: Apr. 9, 1985

[54] SANITARY FOOD DISPENSER

[76] Inventor: Joseph S. Jondahl, 9142 S. Lakewood, Tulsa, Okla. 74136

[21] Appl. No.: 436,599

[22] Filed: Oct. 25, 1982

[51] Int. Cl.[3] ..... B05C 5/04

[52] U.S. Cl. ..... 118/20; 99/483; 118/25

[58] Field of Search ..... 99/483, 345; 221/76, 221/96, 81, 150 A, 150 R; 118/25, 20, 23; 312/125, 135, 236

[56] References Cited

U.S. PATENT DOCUMENTS

| | | | |
|---|---|---|---|
| 1,771,199 | 7/1930 | Webber | 221/81 |
| 3,593,882 | 7/1971 | Rhindress | 221/150 A |
| 4,061,083 | 12/1977 | Caliva | 118/24 X |
| 4,262,586 | 4/1981 | Miller et al. | 118/25 X |

*Primary Examiner*—John P. McIntosh

*Attorney, Agent, or Firm*—Head, Johnson & Stevenson

[57] ABSTRACT

A sanitary customer attended food dispenser for dispensing individual servings of food with desired amount of sauce (e.g. nachos with molten cheese) involving a windowed enclosure containing a carousel of individual food servings and a centrally located heated reservoir of sauce (molten cheese) actuated by an external pump plunger handle. The enclosure is further equipped with a door for withdrawal of the food serving which indexes the carousel through a rotation equivalent to the advancement by the relative position of one food serving for each time the door is opened and then closed.

6 Claims, 9 Drawing Figures

SANITARY FOOD DISPENSER

BACKGROUND OF THE INVENTION (1) Field of the Invention

This invention relates to a customer attended sanitary food dispenser. More specifically, it relates to a sanitary food dispenser for dispensing individual food servings with a quantity of sauce or toppings selected by the customer.

(2) Background of the Invention

Over the last few decades the fast food industry has continuously evolved and grown into what now amounts to an extremely significant and economically important phase of our retail economy. One of the more recent phases of this evolution, which incidentally parallels changes in other retail distribution systems, is the increasing use of customer attended (do-it-yourself) food dispensers. However, whenever such a concept is implemented, a justifiable concern as to maintaining sanitary conditions and an overall healthy environment is important, particularly when the food product is not amenable to being wrapped and/or requires a final preparation step such as applying sauces, condiments, or the like. Thus, a need for a sanitary food dispenser capable of dispensing individual food servings such as various chips and the like with sauce toppings (e.g. nachos with molten cheese, the so-called frito pie, etc.) on a customer attended basis still exists.

SUMMARY OF THE INVENTION

In view of the need for customer attended equipment, I have discovered an improved food dispenser comprising:

(a) a sanitary, windowed enclosure;

(b) a carousel within the enclosure adapted to hold containers of individual servings of food visible through the window;

(c) a door in the enclosure for access to the visible individual food servings and adapted to index the carousel through a rotation equivalent to the advancement by the relative position of one food serving for each time the door is opened and then closed; and (d) a sauce dispenser adapted to dispense sauce on the next visible food serving to be withdrawn from the food dispenser.

The present invention further provides for a food dispenser wherein the sauce dispenser is a centrally located pump, spigot, and sauce reservoir within the enclosure with a manual pump handle extending coaxially to the center of rotation of the carousel and exiting the top of the enclosure such as to allow the customer to pump sauce on said next visible food serving.

Preferably, the sauce dispenser is heated such as to dispense hot molten sauce and the enclosure is heated to dispense hot servings of food. For convenience the enclosure is further equipped with an additional door for refilling said carousel and sauce dispenser. In one preferred embodiment the carousel is adapted to retain individual servings of nachos, and the heated sauce dispenser is adapted to dispense molten cheese.

It is a primary object of the present invention to provide a customer attended food dispenser that displays individual servings of food to which the customer adds a heated sauce.

It is an additional object that this be performed in a sanitary enclosure with a door being provided to remove the food serving and that the opening and closing of the door causes the next serving to be positioned for the next customer. Fulfillment of these objects and the presence and fulfillment of other objects will be apparent upon complete reading of the application taken in conjunction with the attached drawings.

DESCRIPTION OF THE PREFERRED EMBODIMENTS

Figure 1:
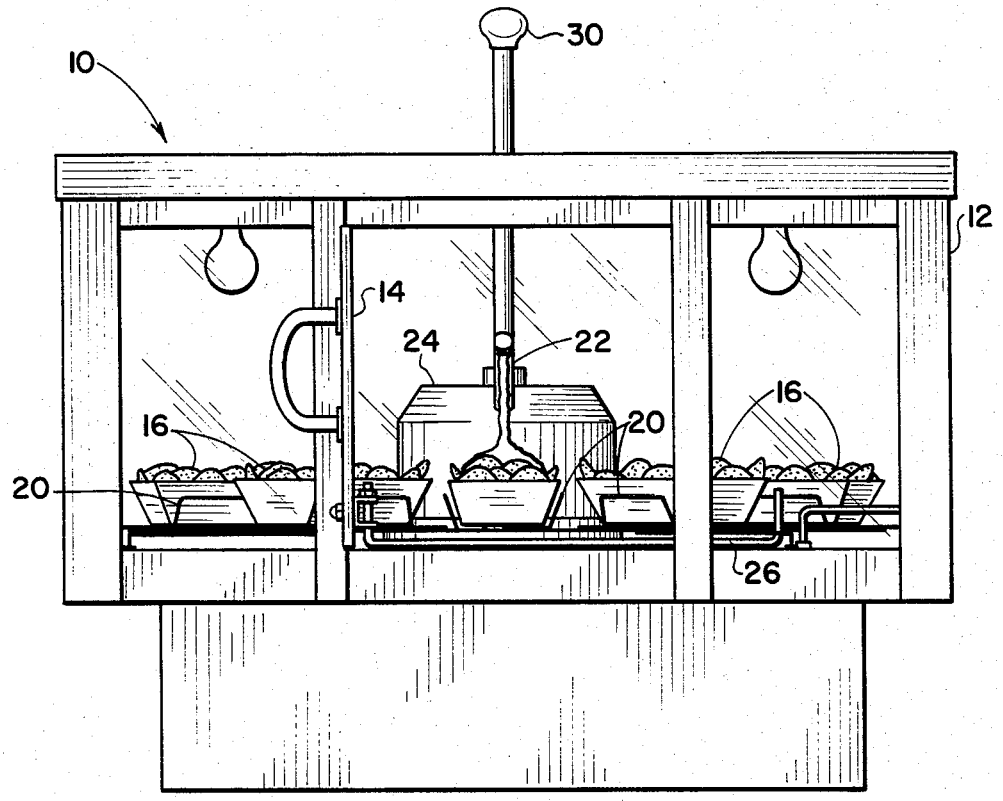
FIG. 1 illustrates a front perspective view of the food dispenser according to the present invention with individual servings of chips on the carousel.

The improved sanitary food dispenser according to the present invention, how it functions, and the advantages associated with its use can perhaps be best explained and understood by referencing the drawings. FIG. 1 illustrates a sanitary food dispenser according to the present invention generally designated by the numeral 10. As illustrated, the food dispenser involves a windowed enclosure 12 with a front door 14 (partially opened in this illustration) allowing access to a series of individual food servings 16 positioned on a rotatable carousel 18. The carousel 18 is equipped with a series of wire partitions 20 to correctly align the individual container of food 16 below the spigot 22 of the centrally located sauce pump 24. The door 14 is further equipped with an actuating rod 26 that interconnects with the cogged notches 28 (see FIGS. 3 and 4) around the perimeter of carousel 18, such that the carousel rotates through an angle sufficient to advance the relative position of the individual food servings 16 each time the door 14 is opened and closed. A manual pump handle 30 is provided at or near the center of rotation of the carousel and exits the top of the enclosure 12 such that the customer can select the quantity of sauce to be applied to the food serving.

Figure 2:
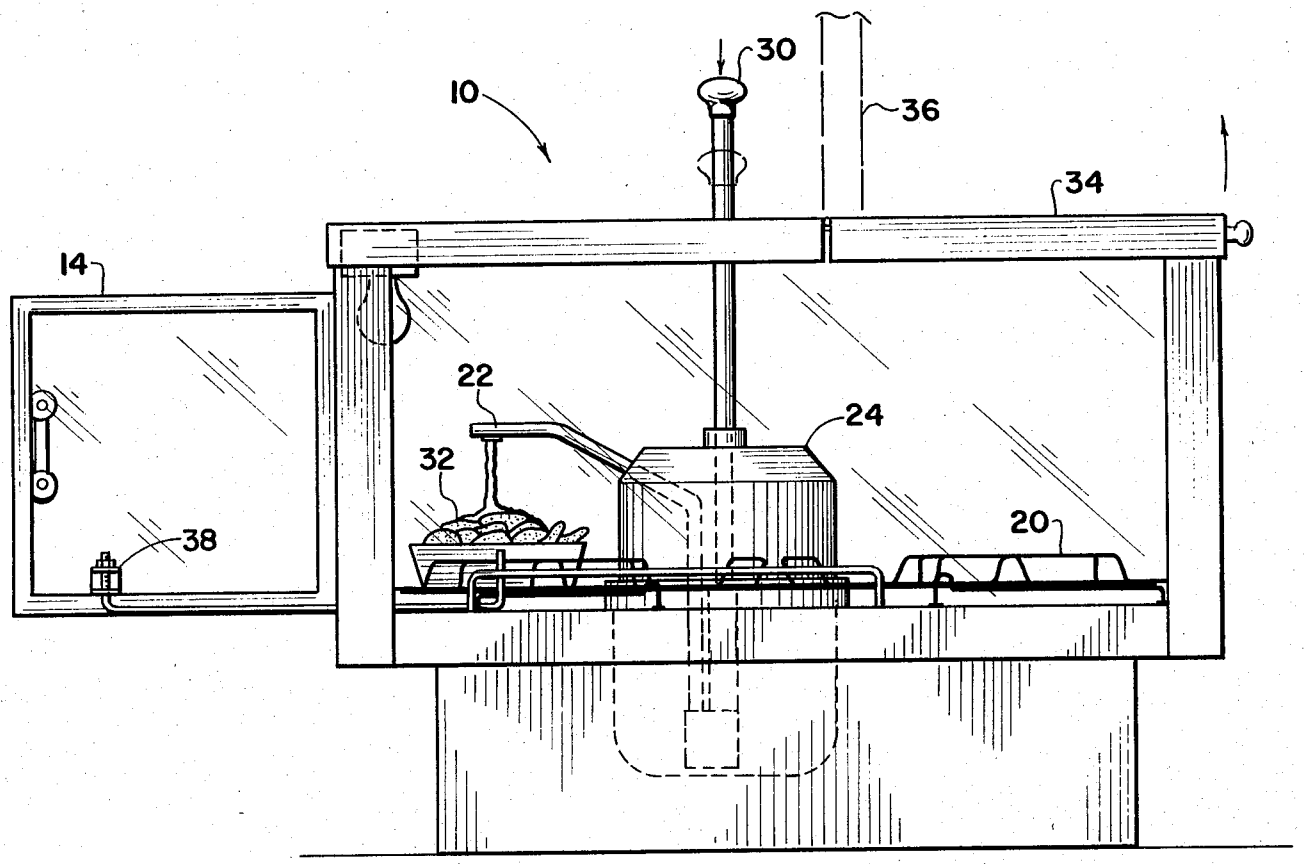
FIG. 2 is a side view of the food dispenser of FIG. 1 with only one serving of chips on the carousel.

FIG. 2 illustrates a side view of the sanitary food dispenser 10 with a single food serving and container 32 positioned below the spigot 22 and in front of partially opened door 14. As illustrated, the top rear portion 34 of the sanitary food dispenser 10 is hinged such as to allow access to the interior by elevating this lid to an upright silohuetted position 36. In this manner the food dispenser 10 can be serviced by the proprietor from behind the counter or the like.

Figure 7:
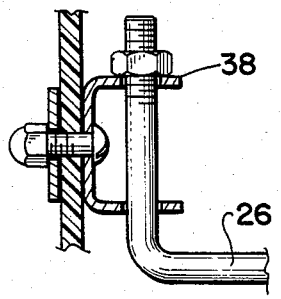
FIG. 7 illustrates an enlarge view of the actuator arm and door mounting of FIG. 1.
Figure 3:
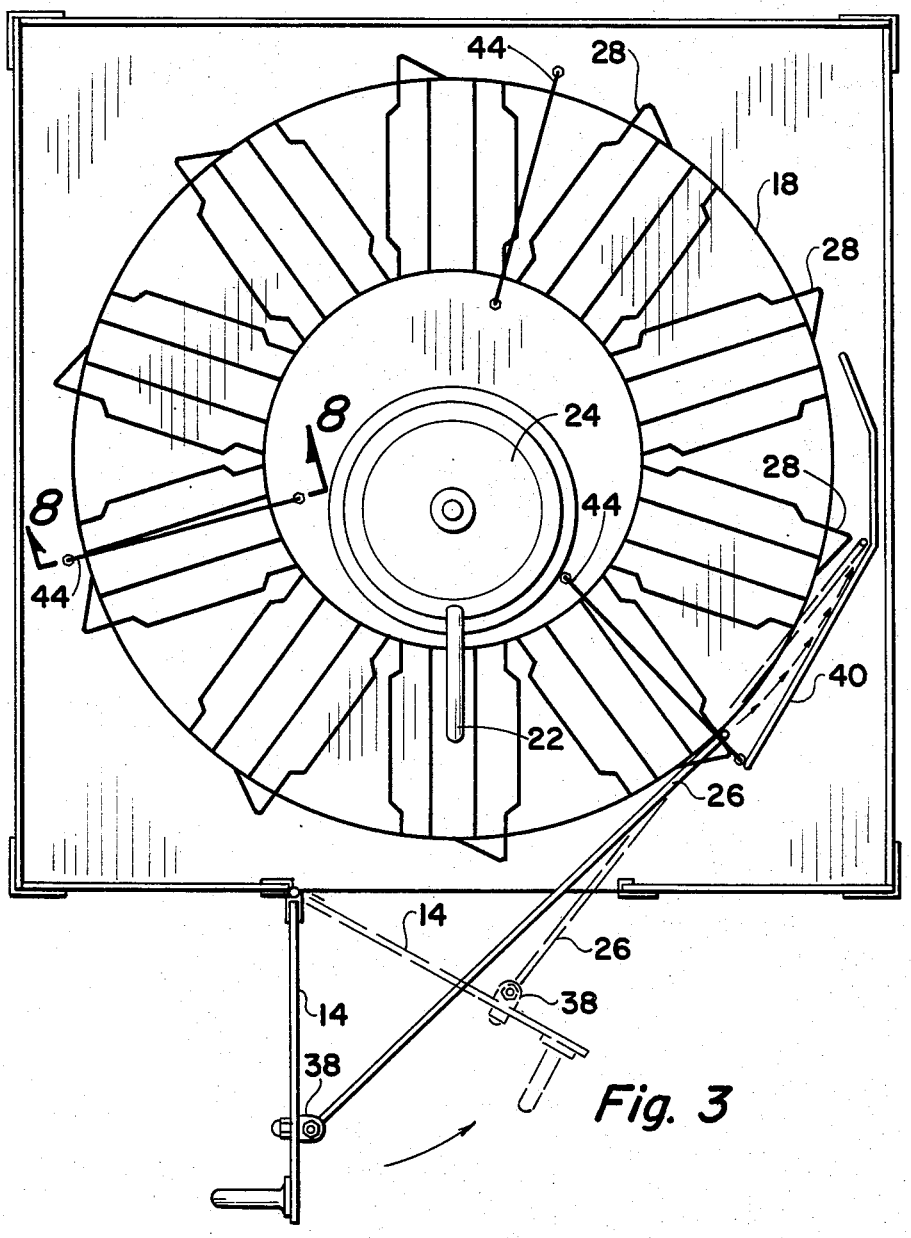
FIG. 3 illustrates a top cut-away view of the food dispenser of FIG. 1 less the food servings as seen through plane 3—3.
Figure 4:
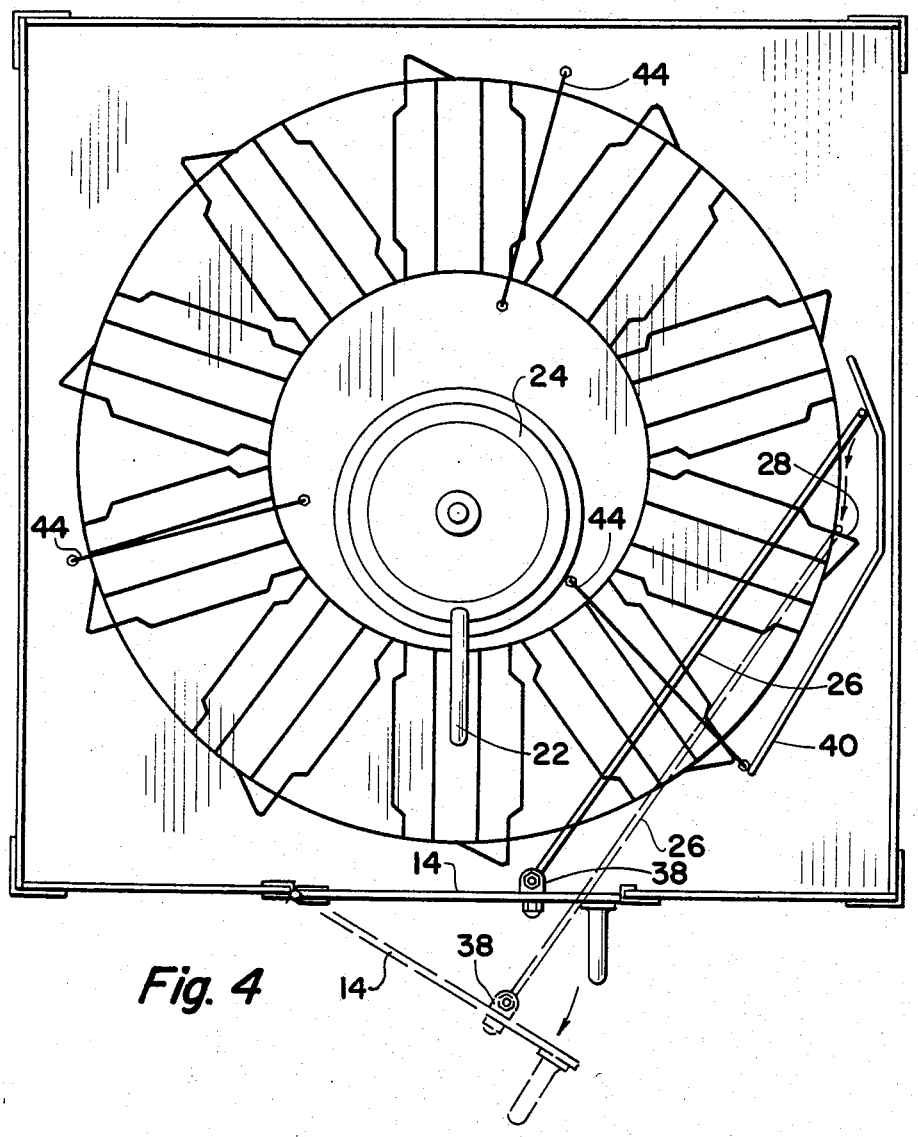
FIG. 4 illustrates a top cut-away view of the food dispenser of FIG. 3 as the door is being opened.

FIGS. 3 and 4 illustrate cut-away top views of carousel 18 less the food serving 16. The interconnecting actuator rod 26 is attached to the open door 14 at a pivot fastener 38 (for more details, see FIG. 7). The relationship of this actuator rod 26 with carousel 18 and advancing cogs 28 can be more clearly seen in FIGS. 3 and 4. Each time the door opens and closes, the actuator rod 26 engages the cogs 28 and turns the carousel 18 through the desired angle advancing the next individual food serving to the stop position directly below the pump spigot 22, as illustrated in FIG. 3. As the door 14 is closed (see dashed line and arrows of FIG. 3), the unattached end of actuator rod 26 swings away from the carousel 18 and rides along the retaining guide member 40 to an alternate position behind the next cog 28 as illustrated in FIG. 4. When the next customer begins to open the door 14 (see dashed lines and arrows of FIG. 4), the actuator rod 26 leaves guide member 40 and engages the backside of cog notch 28. When the door has been opened to the stop position, the carousel 18 will have advanced the next food serving to the position in front of open door 14 and directly below spigot 22.

Figure 5:
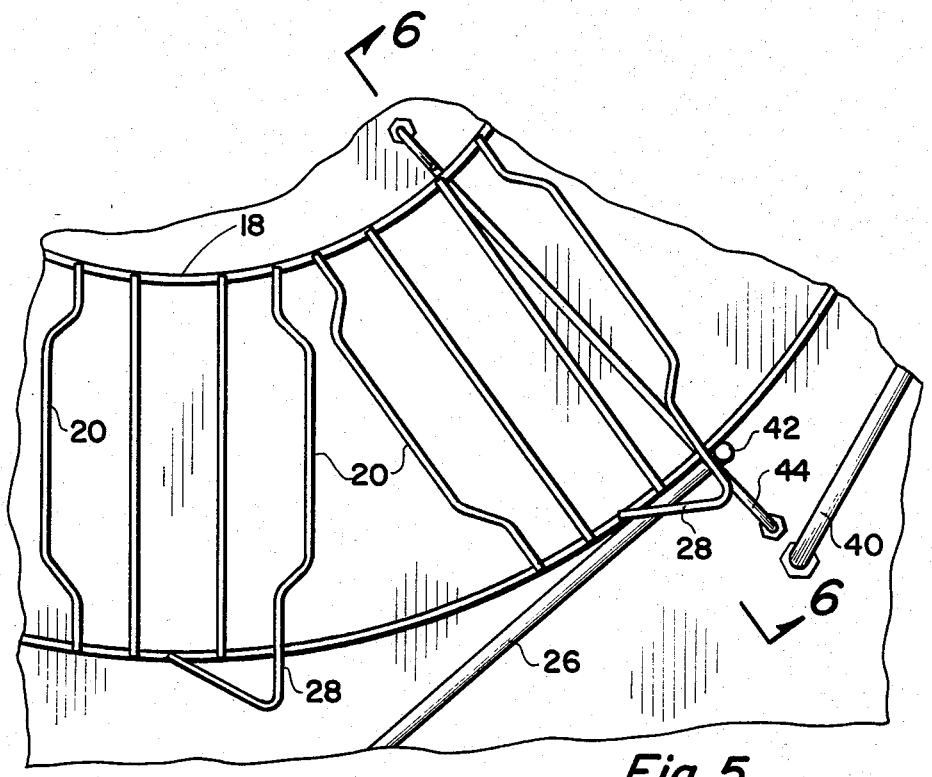
FIG. 5 illustrates an enlarged plan view of the stop position of FIG. 1.
Figure 6:
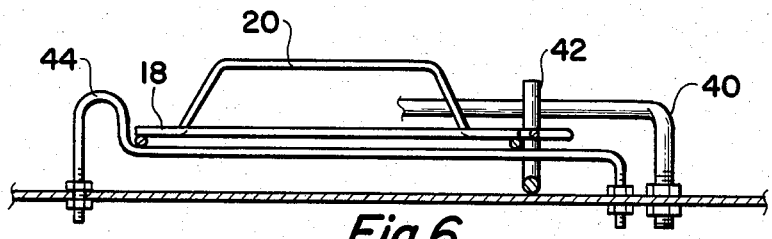
FIG. 6 is a cut-away view of the stop position of FIG. 5 as seen through plane 6—6.

As seen in more detail in FIGS. 5 and 6, the actuator rod 26 engaged to cog 28 advances the carousel 18 until the upturned end 42 stops on carousel support member 44. Thus, the opening of door 14 and the subsequent advancement of carousel 18 is inherently limited to a relative motion that advances the next serving.

Figure 8:
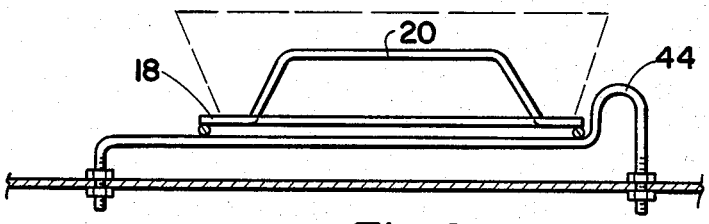
FIG. 8 is a cut-away view of the carousel food container holder of FIG. 4 as seen through plane 8—8.

As further illustrated in FIG. 8, the carousel rests on a series of carousel support members 44 positioned about the interior of the food dispenser. In this manner the carousel 18 frictionally slides over the support members 44.

Figure 9:
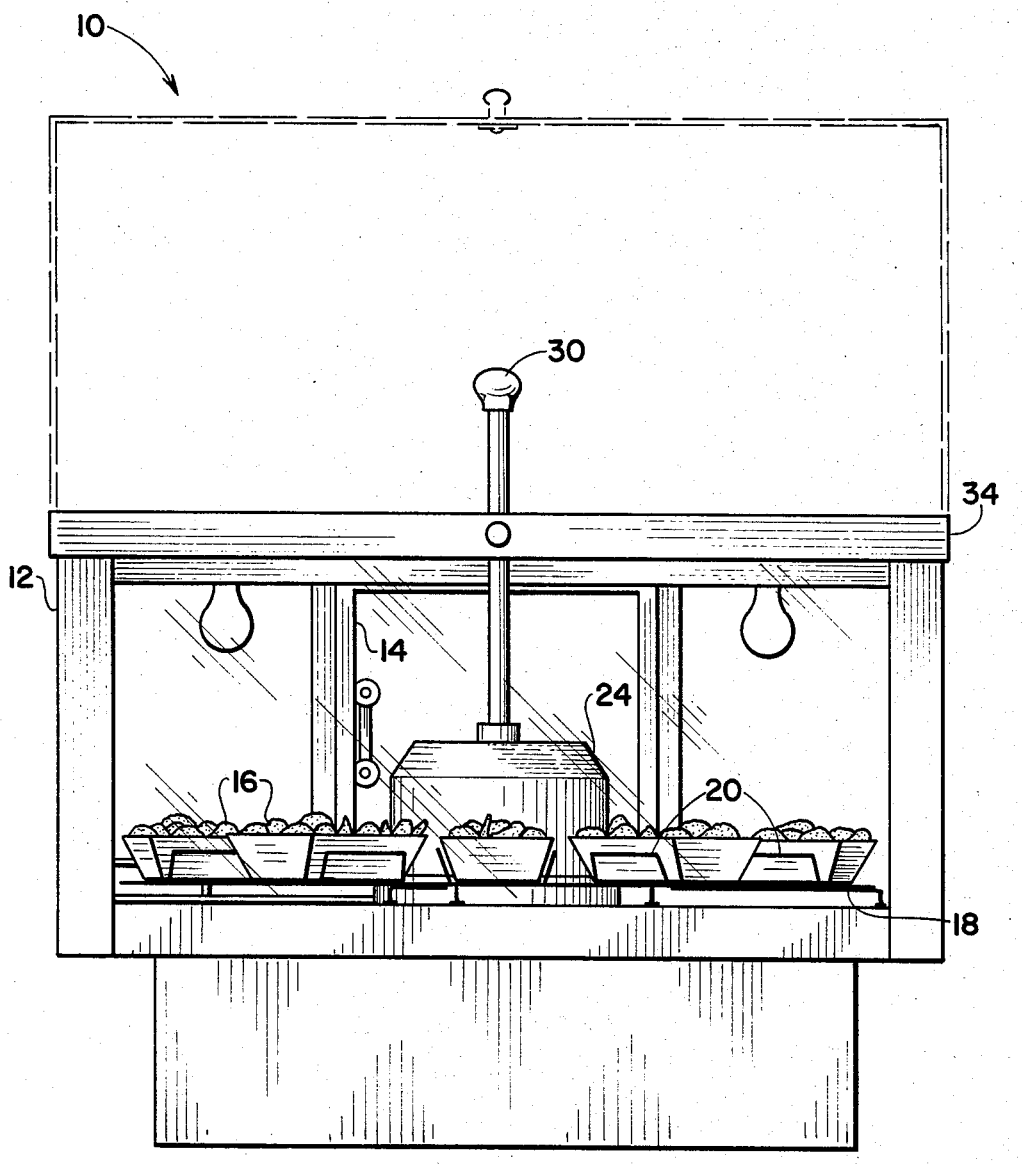
FIG. 9 is a rear view of the food dispenser of FIG. 1.

Again, as seen in FIG. 9, the rear top portion of the sanitary food dispenser 10 is equipped with a service door 34 that opens upward (see dashed lines 36), thus allowing the carousel to be filled and serviced. The pump reservoir 24 preferably contains a heater element (not shown) to warm the sauce and keep the entire food dispenser and food warm. Similarly, appropriate lighting can be provided to heat and illuminate the food.

In principle, the carousel can be designed to rotate either clockwise or counterclockwise and the rotation can be accomplished either simultaneously with the opening or closing motion of the door simply by selecting the relative direction of the actuator rod and door and the relative slope on the individual cogs on the perimeter of the carousel. Optionally, further shielding can be provided around the individual food serving exposed to the customer when the door is opened. The interior of the enclosure can also be optionally equipped with internal lighting and/or heating of the food. Preferably the enclosure and internal components are made from stainless steel or other appropriate material amenable to easy cleaning and maintaining of sterile conditions. The sauce dispenser can be essentially any device compatible with the ingredients being dispensed and compatible with the basic concept of maintaining a sanitary environment. The sauce dispenser's relative position within the enclosure is somewhat arbitrary provided a spigot or equivalent device can be directed to the next food container to be withdrawn from the dispenser. Preferably a heated pump (as illustrated in the drawings) is employed when molten cheese or the like is used as the sauce. However, a gravity fed chute with elevated sauce reservoir is to be considered equivalent and can be employed advantageously when a heterorgeneous sauce is to be applied (e.g. chili onto corn chips for frito pie). Also, multiple sauce dispensers are contemplated to be within the scope of the disclosure.

The mechanical device or advancements means employed to index the carousel from one position to the next position can be any such device well known in the art, including by way of example but not limited thereto, ratchets, chains, gears, belts and combinations thereof or the like.

Having thus described the preferred embodiments with a certain degree of particularity, it is manifest that many changes can be made in the details of construction, arrangement and fabrication of the elements and their uses without departing from the spirit and scope of the invention. Therefore, it is to be understood that the invention is not limited to the embodiment set forth herein for purposes of exemplification, but is to be limited only by the scope of the attached claims, including a full range of equivalents to which each element thereof is entitled.

I claim:

1. A food dispenser comprising:

(a) a sanitary, windowed enclosure;

(b) a carousel within said enclosure adapted to hold containers of individual servings of food visible through said window;

(c) a door in said enclosure for access to said visible individual food servings and adapted to index said carousel through a rotation equivalent to the advancement by the relative position of one food serving for each time said door is opened and then closed; and (d) a sauce dispenser adapted to dispense sauce on the next visible food serving to be withdrawn from said food dispenser.

2. A food dispenser of claim 1 wherein said sauce dispenser is a centrally located pump, spigot, and sauce reservoir within said enclosure with a manual pump handle extending coaxially to the center of rotation of the carousel and exiting the top of said enclosure such as to allow the customer to pump sauce on said next visible food serving.

3. A food dispenser of claim 2 wherein said sauce dispenser is heated such as to dispense hot molten cheese.

4. A food dispenser of claim 2 wherein said enclosure is heated to dispense hot servings of food.

5. A food dispenser of claim 1, 2, 3 or 4 wherein said enclosure is further equipped with an additional door for refilling said carousel and sauce dispenser.

6. A food dispenser of claim 3 wherein said carousel is adapted to retain individual servings of nachos, and said heated sauce dispenser is adapted to dispense molten cheese.

* * * * *